United States Patent [19]

Cordingley et al.

[11] Patent Number: 5,045,009

[45] Date of Patent: Sep. 3, 1991

[54] MECHANICAL MEANS AND PROCESS FOR SEVERING A TENSED FOIL SHADOW MASK

[75] Inventors: Lowell A. Cordingley, Des Plaines; Lawrence W. Dougherty, Sleepy Hollow; Allan D. Kautz, Naperville; Armando V. Marino, Elmhurst, all of Ill.

[73] Assignee: Zenith Electronics Corporation, Glenview, Ill.

[21] Appl. No.: 519,090

[22] Filed: May 4, 1990

[51] Int. Cl.[5] ..... H01J 29/07

[52] U.S. Cl. ..... 445/30; 83/18; 83/175; 83/452; 83/575; 83/639.1

[58] Field of Search ..... 83/13, 531, 533, 620, 83/637, 652, 679, 660, 575, 653, 654, 655, 656, 657, 684, 687, 694, 575, 639.1, 175, 18, 452; 445/30

[56] References Cited

U.S. PATENT DOCUMENTS

| | | | |
|---|---|---|---|
| 119,737 | 10/1971 | Bolthoff | 83/653 |
| 2,423,601 | 7/1947 | MacArthur | 83/689 X |
| 3,532,016 | 10/1970 | Lane | 83/637 X |
| 3,614,369 | 10/1971 | Medley | 83/175 X |
| 3,786,708 | 1/1974 | Mumper | 83/689 X |
| 4,633,742 | 1/1987 | Gutowski et al. | 83/639.1 |
| 4,790,786 | 12/1988 | Strauss | 445/68 |
| 4,828,523 | 5/1989 | Fendley et al. | 445/30 |
| 4,891,546 | 1/1990 | Dougherty et al. | 445/30 X |
| 4,926,677 | *5/1990 | Waldrer | 83/575 |

*Primary Examiner*—Frank T. Yost
*Assistant Examiner*—Kenneth E. Peterson

[57] ABSTRACT

An apparatus and process for use in the manufacture of a tension-mask color cathode ray tube provides for mechanically severing a waste portion from the useful portion of an in-process foil mask secured to mask-support means extending from a faceplate. The apparatus comprises means for support mask-servering means adjacent ot the mask outside the mask support means, and means for translating the mask-severing means into engagement with the mask to sever the mask from the mask support means adjacent all points along the mask-support means.

13 Claims, 3 Drawing Sheets

MECHANICAL MEANS AND PROCESS FOR SEVERING A TENSED FOIL SHADOW MASK

BACKGROUND OF THE INVENTION

Field of the Invention

This invention relates to color cathode ray picture tubes, and is addressed specifically to an apparatus and process for use in the manufacture of tubes having a flat tension mask.

In U.S. Pat. No. 4,828,523 to Fendley et al, of common ownership herewith, a welding apparatus is described and claimed which utilizes a laser beam for welding an in-process foil shadow mask to a faceplate-mounted, frame-like shadow mask support structure secured to the inner surface of an in-process faceplate. The apparatus comprises mapping means for creating a map of the mask-receiving surface of the support structure. Means are included for moving the laser beam to follow the map in welding relationship to the mask-receiving surface, and controlling the beam to weld the mask to the support structure. Following the welding process, the border of the mask is severed by the same beam.

Although mask-severing by laser beam has proved to be production effective, there is a liability in that any overshoot and/or reflection of the high-power beam in severing the mask can damage the material of the mask-support structure and/or the glass of the faceplate. As a result, it has been necessary to build beam-shielding means into the mask-support structure to deflect the severing beam. Alternately, a separate beam shield must be manually emplaced in the path of the beam before each welding operation. Another disadvantage of severing the border for a mask by laser beam is that beam, in impacting the faceplate or the shielding means, tends to produce artifacts in the form of particles and other residue that can occlude the nearby apertures in the centrally located screening area.

The "mask-tensing fixture," as it is termed in the present application, is described and claimed in U.S. Pat. No. 4,790,786 of common ownership herewith. The fixture, which is referred to as a "factory fixture frame" in the cited patent, provides for mounting an in-process shadow mask during photoexposure of an in-process faceplate in a lighthouse. The frame comprises generally rectangular frame means and quick-release mechanical mask-retaining means for temporarily and removably supporting an in-process shadow mask in tension. By virtue of this fixture, an in-process shadow mask can be precisely registered and re-registered with a lighthouse and an in-process faceplate for the photoexposure of the in-process faceplate while retaining the in-process shadow mask in tension, all as described in the '786 patent.

OBJECTS OF THE INVENTION

It is a general object of this invention to provide apparatus and process facilitating the manufacture of color cathode ray tubes having a tensed foil shadow mask.

It is an object of this invention to provide mechanical means for severing the border from an in-process foil mask.

It is another object of this invention to provide mechanical means for severing the border from an in-process foil mask that does not produce artifacts from the severing process.

It is yet another object to provide mechanical mask severing means that does not induce stress in the the mask as a result of the severing process.

It is a further object to provide mechanical mask-severing means which can be operated either manually or automatically.

It is another object to provide mechanical mask-severing means that can sever the mask neatly and as close as possible to the structure that supports the mask.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DESCRIPTION OF THE PREFERRED EMBODIMENT

To facilitate understanding of the apparatus and process according to the invention for use in the manufacture of a tension mask color cathode ray tube, a brief description of the tube is provided in following paragraphs.

Figure 1:
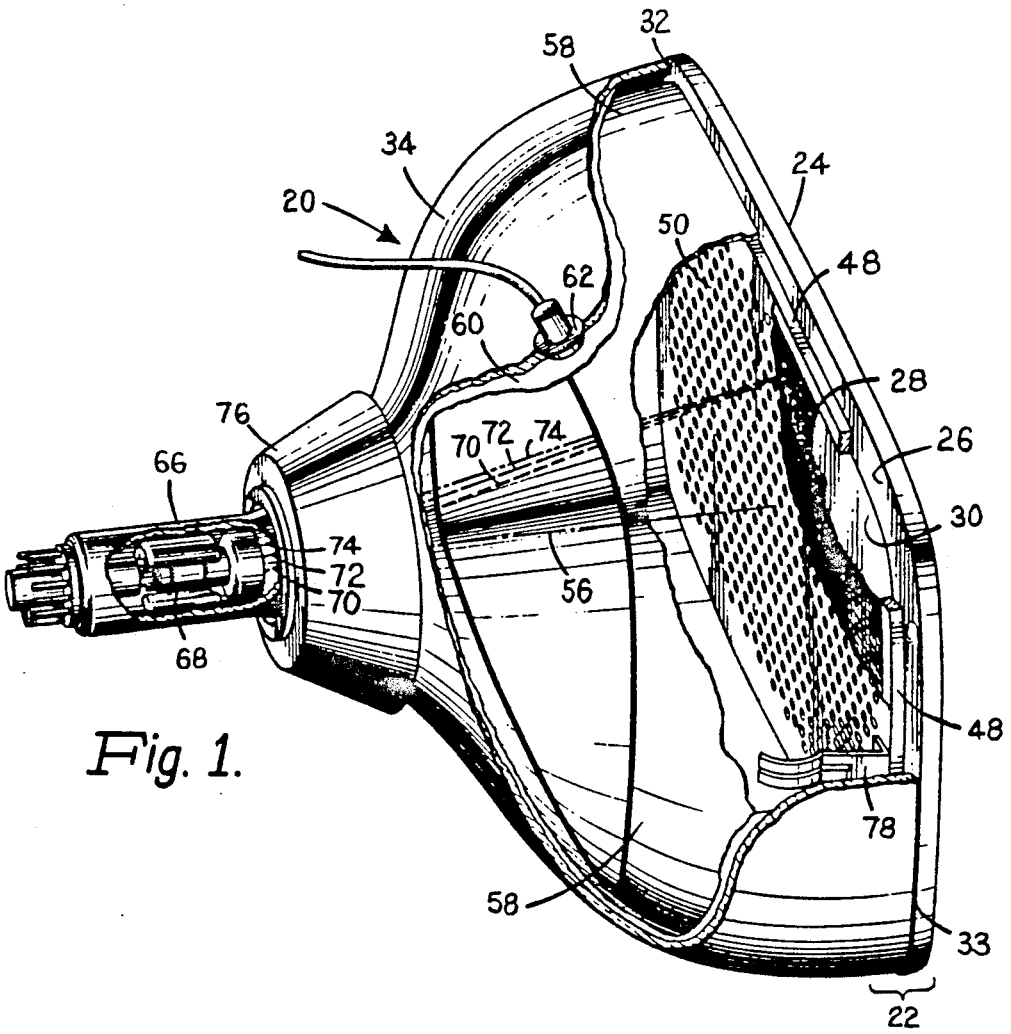
FIG. 1 is a side view in perspective of a color cathode ray tube having a flat faceplate and a tensed foil shadow mask, with cut-away sections that indicate the location and relation of the faceplate, the shadow mask, and the mask support structure to other major tube components.

With reference to FIG. 1, color cathode ray tube 20 is shown as having a front assembly 22 that includes a faceplate 24. On the inner surface 26 of face-plate 24—known as the "screening area"—there is deposited a phosphor screen 28. A film of aluminum 30 is indicated as covering the screen 28. The peripheral sealing area 32 of faceplate 24 is depicted as being attached to the peripheral sealing area 33 of a funnel 34.

Front assembly 22 includes a shadow mask support means comprising a structure 48 shown as extending from faceplate 24; structure 48 provides for receiving and securing a metal foil shadow mask 50 in tension. The anterior-posterior axis of tube 20 is indicated by reference number 56. A magnetic shield 58 is shown as being enclosed within funnel 34. High voltage for tube operation is indicated as being applied to a conductive coating 60 on the inner surface of funnel 34 by way of an anode button 62 connected in turn to a high-voltage conductor 64.

The neck 66 of tube 20 is represented as enclosing an in-line electron gun 68, depicted as providing three discrete in-line electron beams 70, 72 and 74 for exciting respective red-light-emitting, green-light-emitting, and blue-light-emitting phosphor elements on screen 28. Yoke 76 receives scanning signals and provides for the scanning of beams 70, 72 and 74 across screen 28. A contact spring 78 provides an electrical path between the funnel coating 60 and mask support structure 48.

Figure 2:
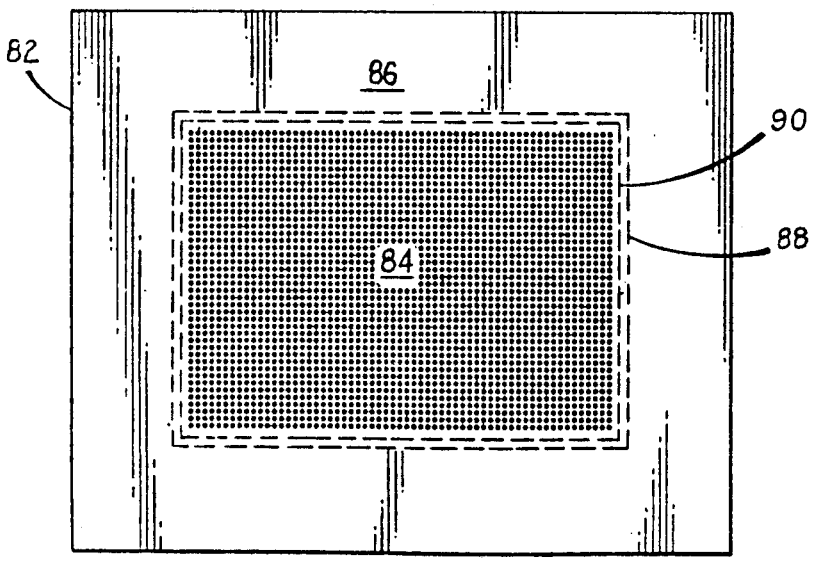
FIG. 2 is a plan view of an in-process shadow mask showing the central field of apertures—the "useful" portion—as enclosed by a border of unperforated metal—the "waste" portion—which is severed by the mechanical means and process according to the invention.

FIG. 2 depicts an in-process shadow mask 82 which comprises a center field 84 of apertures intended for the color-selection function in the completed tube. Center field 84 is indicated as being enclosed by a border 86 of unperforated metal. Border 86 represents a waste portion which is severed from center field 84—the useful portion—by mechanical means according to the invention. The line of severance 88 between center field 84 and border 86 is indicated by the outer dashed line, and the weld line 90, wherein the mask is welded to the underlying mask support structure, is indicated by the inner dashed line.

Figure 3:
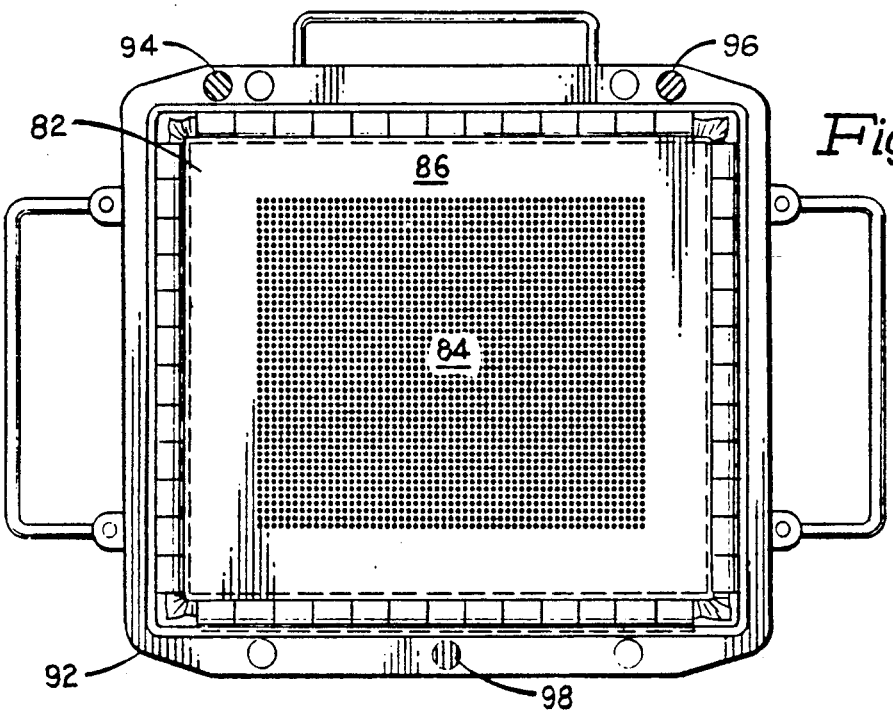
FIG. 3 is a plan view of the mask-tensing fixture described and claimed in the referent '786 patent, with the in-process shadow mask depicted in FIG. 2 mounted in tension therein.

FIG. 3 depicts a mask-tensing fixture 92 which is the subject of the aforedescribed '786 patent of common ownership herewith. Mask-tensing fixture 92 provides for mounting an in-process shadow mask during the photoexposure of an in-process faceplate in a lighthouse, and serves as a fixture for the process of severing an in-process mask. The in-process mask 82 shown by FIG. 2 is mounted in fixture 92 and tensed and clamped by the means fully described in the '786 patent. Of particular interest to the present application is the presence of three groove means 94, 96 and 98 (also described in the '786 patent) which in conjunction with ball means (not shown) are components of six-point registration means; groove means 94, 96 and 98 are used to provide for registration of the mechanical mask-severing apparatus with the mask support structure that extends from the inner surface of the faceplate, as will be described.

Figure 4:
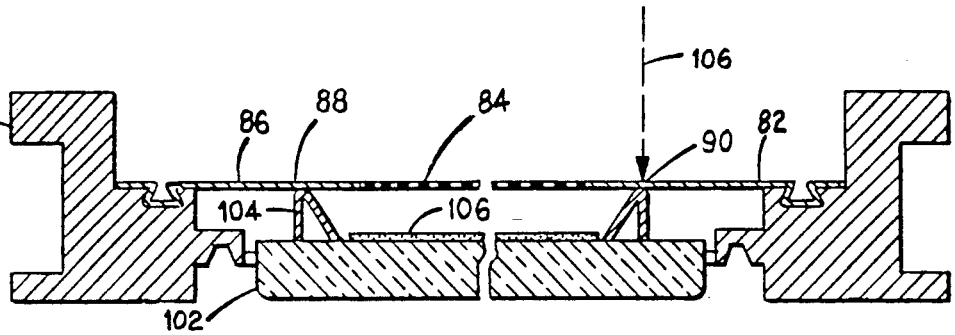
FIG. 4 is a cross-sectional view in elevation that indicates the relationship of faceplate, the mask support structure, and a mask as held in tension in the mask tensing fixture, with the mask-severing area indicated schematically.

The relationship of the foregoing components is shown in the elevational view of FIG. 4, in which in-process mask 82 is indicated as being clamped in mask-tensing fixture 92. An in-process faceplate 102 is indicated as being held within the mask-tensing fixture 92, with mask support means 104 extending from the faceplate 102 and in contact with mask 82. The mask support means depicted are described and claimed in U.S. Pat. No. 4,695,761 to Fendley, of common ownership herewith. As the tube is in near-final stages of production, faceplate 102 is indicated as having a screen 106 deposited thereon.

The welding of the mask 82 to the underlying support structure 104 along weld line 90 (indicated by FIG. 2) is indicated schematically by arrow 106. The line of severance 88 (also see FIG. 2), wherein the border 86 of mask 82 is severed from the center field of apertures 84, is also indicated.

An apparatus and process for mapping the location of a mask support structure and welding a mask thereto by a high-energy beam, and severing the border of a mask by means of the same beam, is described and claimed in the referent '512 patent.

Figure 5:
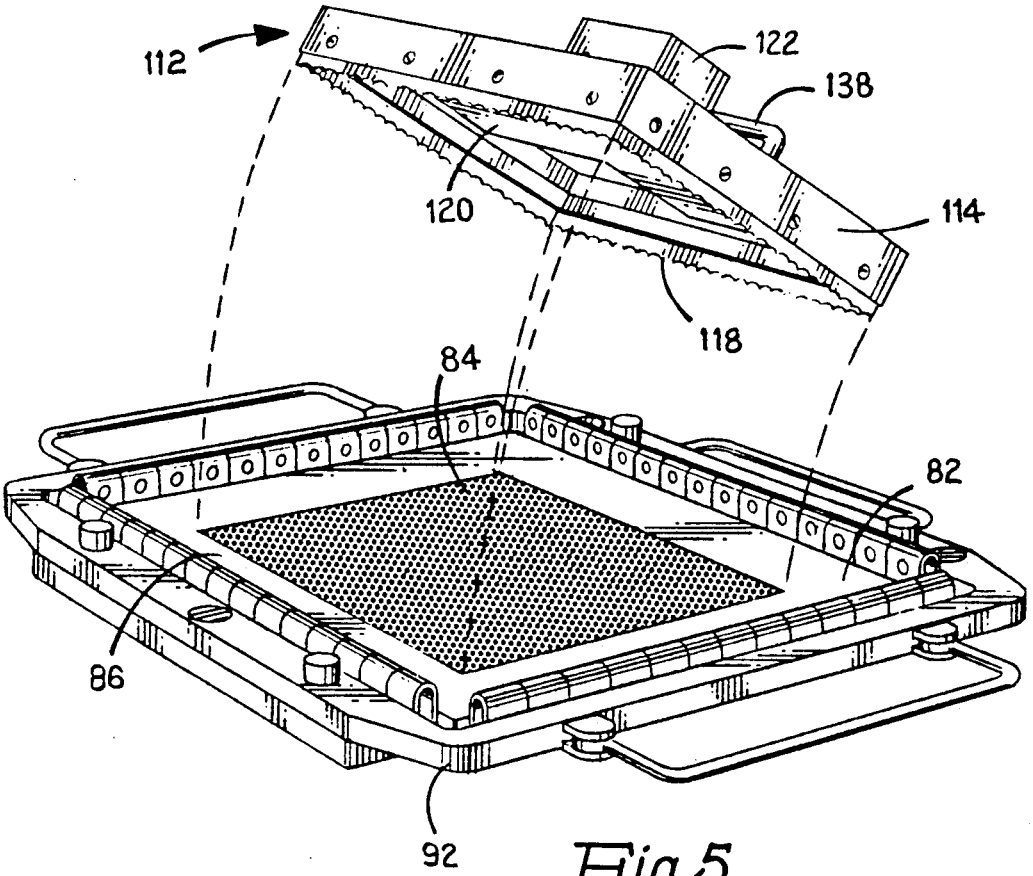
FIG. 5 is a view in perspective of an embodiment of an apparatus according to the invention shown as being positioned in preparation for the mechanical mask-severing operation according to the invention.

A preferred embodiment of mask-severing means for mechanically severing an in-process foil mask according to the present invention is depicted in FIG. 5. Mask-severing apparatus 112 is shown as being in opposed conjunction with mask-tensing fixture 92 in preparation for process of mechanically severing the border 86 of mask 82, the waste portion, as tensed in fixture 92, from the centrally apertured area 84, the useful portion. In essence, the mechanical mask-severing apparatus according to the invention comprises means for supporting the mask-severing means adjacent to a mask outside the mask support means, and means for translating the mask-severing means into engagement with the mask to sever the mask from the mask support means adjacent all points along the mask support means.

Figure 6:
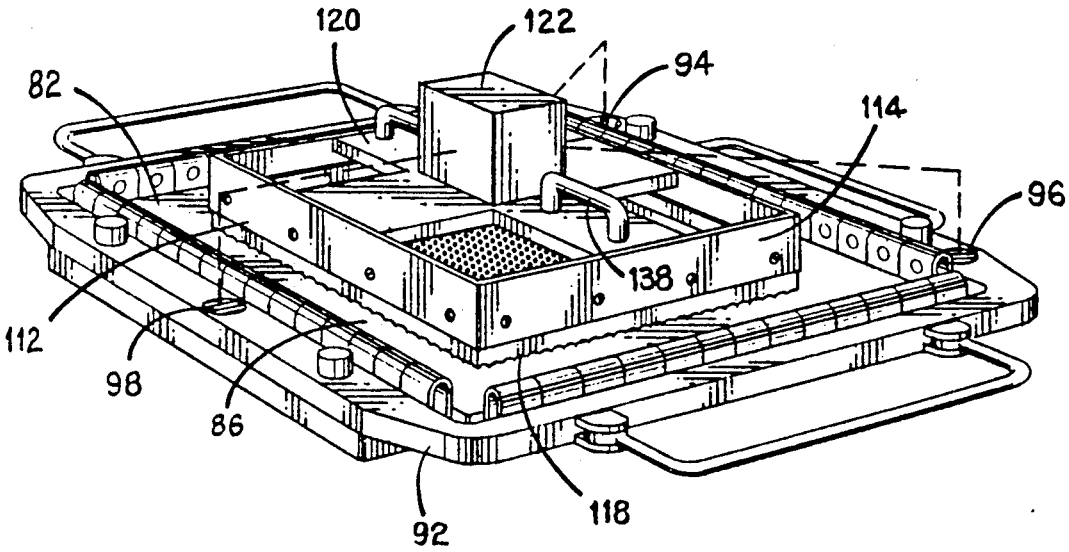
FIG. 6 is a view similar to FIG. 5 in which the mask-severing apparatus according to the invention is indicated as being in severing relationship with a shadow mask.

As indicated by FIG. 5, the mask-severing apparatus 112 according to the invention essentially comprises frame means 114, noted as being consonant in shape with the underlying mask support means 104 but slightly larger than mask support means 104, the approximate location of which is indicated by the weld line 90 indicated by FIG. 2. The means for mask severing on frame means 114 is indicated as comprising piercing means, indicated as being saw-tooth means 118 extending from frame means 114, and shown as being located around the entire periphery of frame means 114. The saw-tooth means 118 serve essentially as piercing blade means to pierce the foil of the shadow mask. In FIG. 6, the mask-severing means 118 on frame means 114 is indicated as being adjacent to mask 82, in preparation for the severing operation.

Frame means 114 will be noted as being buttressed by cross-bracing 120, which is shown as serving to support mask-severing force means 122, shown schematically as a block; severing force means 122 applies a severing force to mask-severing means 118 effective to sever mask 82 from the mask-support structure 104 adjacent all points along the mask support structure.

Figure 7:
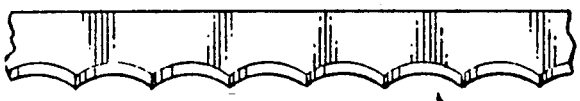
FIGS. 7 and 8 are plan views of two embodiments of mask-piercing means according to the invention.
Figure 8:
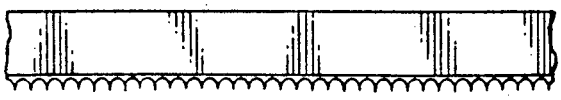

FIG. 7 shows an embodiment of saw-tooth means 126 having a pitch of three teeth per inch, while FIG. 8 depicts saw-tooth means 128 having a pitch of eleven teeth per inch. The range of pitch according to the invention is from three to fifteen teeth per inch. The selection criterion is the use of severing means having a pitch effective to sever the mask with minimum stress on the mask, and to sever the mask cleanly and completely, leaving no partially severed pieces behind. To effectively sever a shadow mask comprising a foil having a thickness of less than 0.001 inch, a pitch of ten teeth per inch is preferred.

Figure 9:
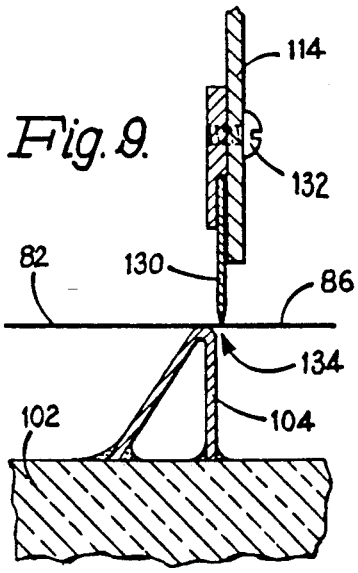
FIG. 9 is a detail view in elevation showing mask-piercing means positioned in mask-severing severing relationship with an underlying mask-support structure.

The embodiments of saw-tooth means shown by FIGS. 7 and 8 comprise band-saw blades cut to the proper length. FIG. 9 depicts schematically means for holding a piercing blade 130 in extension from frame means 114. Means for clamping blade 130 to frame means 118 is indicated by way of example as comprising screw means 132.

FIG. 9 also indicates the details of the relationship of the mechanical mask severing apparatus according to the invention with the mask support structure 104 which underlies mask 82, and which extends from faceplate 102. It will be noted that the frame means 114 and the associated mask-severing means (blade 130), while consonant in shape with mask-support means 104, is slightly larger than the underlying mask support. As a result, the border 86 of the mask 82 is severed along a line just outside of the perimeter of the support structure, leaving an overhang of border material of about 0.125 inch, indicated by reference No. 134.

With reference again to FIG. 6, the mask-severing force indicated schematically by block 122, may comprise impacting means according to the invention, such as hammer means impelled by a piston actuated by compressed air, or hammer means impelled by an electromagnetic force such as that applied by a solenoid. The impacting force applied by either means may be in the range of 40 to 120 lb., and is preferably about 60 lb. for a mask-severing apparatus for a tube having a diagonal measure of 14 inches. (For a two-inch diameter air cylinder, 40 to 120 lb. corresponds to a pressure range of about 13 to 40 psi.) The impacting means may comprise a Model ST2X1/4 4 SR air hammer supplied by Lin-Act Manufacturing Corp. of Rockford, Ill. A suitable electromagnetic hammer apparatus is the Model 24F874 supplied by Guardian Electric of Chicago, Ill. Alternately, the mask-severing force represented by block 122 may comprise vibratory means; suitable vibratory means is Vibrator Model No. 4810 supplied by Brüel and Kjaer of Denmark. Impacting and vibratory apparati having equivalent properties supplied by other manufacturers may as well be used.

With reference to FIG. 6, mask-severing apparatus 112 is indicated as having handle means 138 for convenience in manually emplacing apparatus 112 on the mask 82. Registration with the underlying mask support means can be accomplished either manually or automatically. Automatic registration means may comprise posts (not shown) extending between block 122 and groove means 94, 96 and 98, as indicated diagrammatically by the dash lines therebetween. Means for registering the mask-tensing frame 92 with associated production machinery, and which can be readily adapted for the registration of the mask-severing apparatus according to the invention with a mask-tensing frame, are described in the referent '523 and '786 patents.

After the mask has been welded to the support structure, and upon completion of the severing operation, the front assembly 22 is free of the factory fixture frame 82, and is a viable faceplate assembly complete with a phosphor screen, ready for attachment to a funnel. The attachment of a faceplate assembly 22 with a funnel 34 is depicted in FIG. 1.

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

We claim:

1. In the manufacture of a tension mask color cathode ray tube, a process comprising:

providing a color cathode ray tube faceplate from which extends mask support means separated by a predetermined spacing;

expanding a foil shadow mask and retaining it in tension on a frame;

while in said tensed state in said frame, securing said mask to said mask support means;

supporting piercing blade means in a mount having a span greater than said predetermined spacing of said mask support means;

causing said piercing blade means to make physical contact with said tensed mask between where said mask is joined to said mask support means and where it is supported on said frame; and causing said piercing blade means to pierce said mask to sever a peripheral waste portion thereof from a useful central portion between said mask support means.

2. The process according to claim 1 wherein said piercing blade means comprises sawtooth means.

3. The process according to claim 2 including providing sawtooth means having a pitch effective to sever said mask with minimum stress on said mask.

4. The process according to claim 3 including providing sawtooth means having a pitch in the range of 3 to 15 teeth-per-inch.

5. The process according to claim 3 wherein said sawtooth means has a pitch of ten teeth-per-inch.

6. The process according to claim 1 including hammering said piercing blade means to sever said mask.

7. The process according to claim 6 including hammering said piercing blade means by piston means impelled by compressed air.

8. The process according to claim 6 including hammering said piercing blade means by piston means impelled by an electromagnetic force.

9. The process according to claim 1 including vibrating said piercing blade means with a vibratory motion and force effective to sever said mask.

10. The process according to claim 1 including providing handle means for manually registering said piercing blade means with said mask-support means.

11. The process according to claim 1 including providing means for registering said piercing blade means with said mask-support means.

12. The process according to claim 1 including providing frame means consonant in shape, but slightly larger than said mask-support means, and extending piercing means therefrom effective to sever said mask from said mask-support structure.

13. The process according to claim 1 including providing means for registering said piercing blade means with said mask-support means.

* * * * *